US011898427B2

(12) United States Patent
Zahur et al.

(10) Patent No.: US 11,898,427 B2
(45) Date of Patent: Feb. 13, 2024

(54) NON-COMINGLED CONCENTRIC TUBING PRODUCTION FROM TWO DIFFERENT RESERVOIRS

(71) Applicant: SAUDI ARABIAN OIL COMPANY, Dhahran (SA)

(72) Inventors: Jawad Zahur, Abqaiq (SA); Muhammad Ali Qureshi, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 40 days.

(21) Appl. No.: 17/455,756

(22) Filed: Nov. 19, 2021

(65) Prior Publication Data

US 2023/0160287 A1 May 25, 2023

(51) Int. Cl.
*E21B 43/14* (2006.01)
*E21B 43/02* (2006.01)
(Continued)

(52) U.S. Cl.
CPC ..... *E21B 43/14* (2013.01); *E21B 19/22* (2013.01); *E21B 33/12* (2013.01); *E21B 34/02* (2013.01); *E21B 43/12* (2013.01); *E21B 43/30* (2013.01)

(58) Field of Classification Search
CPC ..... E21B 43/14; E21B 43/142; E21B 43/12; E21B 33/12
See application file for complete search history.

(56) References Cited

U.S. PATENT DOCUMENTS 3,199,592 A * 8/1965 Jacob ..... E21B 43/32 405/59
6,068,053 A * 5/2000 Shaw ..... E21B 43/40 166/267

(Continued)

FOREIGN PATENT DOCUMENTS

RU 82750 U1 5/2009
RU 137332 U1 2/2014

OTHER PUBLICATIONS

Kremenetskiy, M.I., et al., "Permanent Downhole Production Monitoring & Well-testing of Commingled Production Reservoirs", SPE-138049, Society of Petroleum Engineers, Oct. 2010, pp. 1-4 (4 pages).

(Continued)

*Primary Examiner* — Catherine Loikith
(74) *Attorney, Agent, or Firm* — Osha Bergman Watanabe & Burton LLP

(57) ABSTRACT

An apparatus for obtaining fluids via a well includes an outer tubing disposed in the well and set at a shallow reservoir comprising a first fluid, and an inner tubing disposed concentrically within the outer tubing and set at a deeper reservoir further downhole than the shallow reservoir. The deeper reservoir has a second fluid, where a first packer is disposed between the outer tubing and an external tubing and disposed above the shallow reservoir, and a second packer is disposed between the outer tubing and the inner tubing and disposed above the deeper reservoir. The second packer blocks an annulus through which the first fluid is extracted via the outer tubing. The first fluid is obtained from the shallow reservoir and the second fluid is obtained from the deeper reservoir by drilling via the well.

14 Claims, 3 Drawing Sheets

(51) Int. Cl.

| | |
|---|---|
| ***E21B 33/12*** | (2006.01) |
| ***E21B 43/12*** | (2006.01) |
| ***E21B 34/02*** | (2006.01) |
| ***E21B 19/22*** | (2006.01) |
| ***E21B 43/30*** | (2006.01) |

(56) References Cited

U.S. PATENT DOCUMENTS

| | | | | |
|---|---|---|---|---|
| 6,082,452 | A * | 7/2000 | Shaw | E21B 34/06 166/313 |
| 6,722,440 | B2 | 4/2004 | Turner et al. | |
| 7,543,647 | B2 | 6/2009 | Walker | |
| 8,316,938 | B2 * | 11/2012 | Al-Jarri | E21B 43/20 166/265 |

OTHER PUBLICATIONS

Seymour, K.P., et al., "Using Cloud Based Well Engineering Data and Wellbore Integrity Analysis to Reduce Risk in Niger Delta Workovers", SPE-198735-MS, Society of Petroleum Engineers, Aug. 2019, pp. 1-22 (22 pages).

* cited by examiner

NON-COMINGLED CONCENTRIC TUBING PRODUCTION FROM TWO DIFFERENT RESERVOIRS

BACKGROUND

In the petroleum industry, wells are built to access and produce hydrocarbons from reservoirs beneath the Earth's surface. Traditionally, a well is designed to produce from one reservoir at a time. However, there are locations where multiple reservoirs are present within the same area, usually at different depths below the surface of the Earth. Generally, in such a situation, one of the reservoirs would be considered incompatible, and production from this reservoir would require the drilling of an additional well. Accordingly, there exists a need for a system wherein a well can produce from multiple reservoirs simultaneously, without any comingling of production fluids.

Further, when a well is drilled, various strings of metal casing are set within the well to aid in drilling and production. However, contact with production and drilling fluids can lead to corrosion of metal casings. Many casing strings are cemented into place within the well, so replacement is not possible. Accordingly, there exists a need for an apparatus wherein metal casings are protected from contact with production and drilling fluids.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to an apparatus for obtaining fluids via a well. The apparatus may include an outer tubing disposed in a well and an inner tubing disposed concentrically within the outer tubing, where the outer tubing is set at a shallow reservoir and the inner tubing is set at a deeper reservoir. The shallow reservoir may produce a first fluid and the deeper reservoir may produce a second fluid. The apparatus may further include a first packer disposed between the outer tubing and an external tubing and disposed above the shallow reservoir. A second packer may be disposed between the outer tubing and the inner tubing and may be disposed above the deeper reservoir, where the second packer blocks an annulus through which the first fluid is extracted via the outer tubing. The first fluid may be obtained from the shallow reservoir and the second fluid may be obtained from the deeper reservoir by drilling via the well.

In another aspect, embodiments disclosed herein relate to a method for obtaining fluids via a well. The method includes running a drill string down a wellbore to set an outer tubing in the well, wherein the well comprises an external tubing and wherein the outer tubing is set at a shallow reservoir comprising first fluid. The method may further include disposing a first packer into the well between the outer tubing and the external tubing and above the shallow reservoir, running the drill string down the wellbore to set an inner tubing and a second packer, which may be disposed between the outer tubing and the inner tubing and above the deeper reservoir, within the outer tubing in the well. The inner tubing is set at a deeper reservoir further downhole than the shallow reservoir, the deeper reservoir comprising a second fluid. The method may also include producing the first fluid from the shallow reservoir, wherein the first fluid is produced via an annulus between the outer tubing and the inner tubing, and producing the second fluid from the deeper reservoir, wherein the second fluid is produced straight through the inner tubing and wherein the second packer blocks the annulus through which the first fluid is extracted via the outer tubing.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Throughout the application the reference to tubing may refer to a string of casing defined as a large-diameter pipe that may be lowered into a well and connected to the surface of the Earth by a wellhead. The reference to tubing may also be referring to a string of production casing defined as a large-diameter pipe that may be lowered into a well and through which production fluids flow.

In one aspect, embodiments disclosed herein relate to producing two or more different fluids from two or more reservoirs within the same well without commingling the fluids. Further, in another aspect, embodiments disclosed herein relate to protecting the external casing annulus from contact with production fluids, reducing the possibility of sweet or sour corrosion. Sweet corrosion refers to the degradation of metal due to contact with carbon dioxide or other similar corrosive agents, not including hydrogen sulfide ($H_2S$). By contrast, sour corrosion refers to the degradation of metal due to contact with hydrogen sulfide ($H_2S$).

Figure 1:
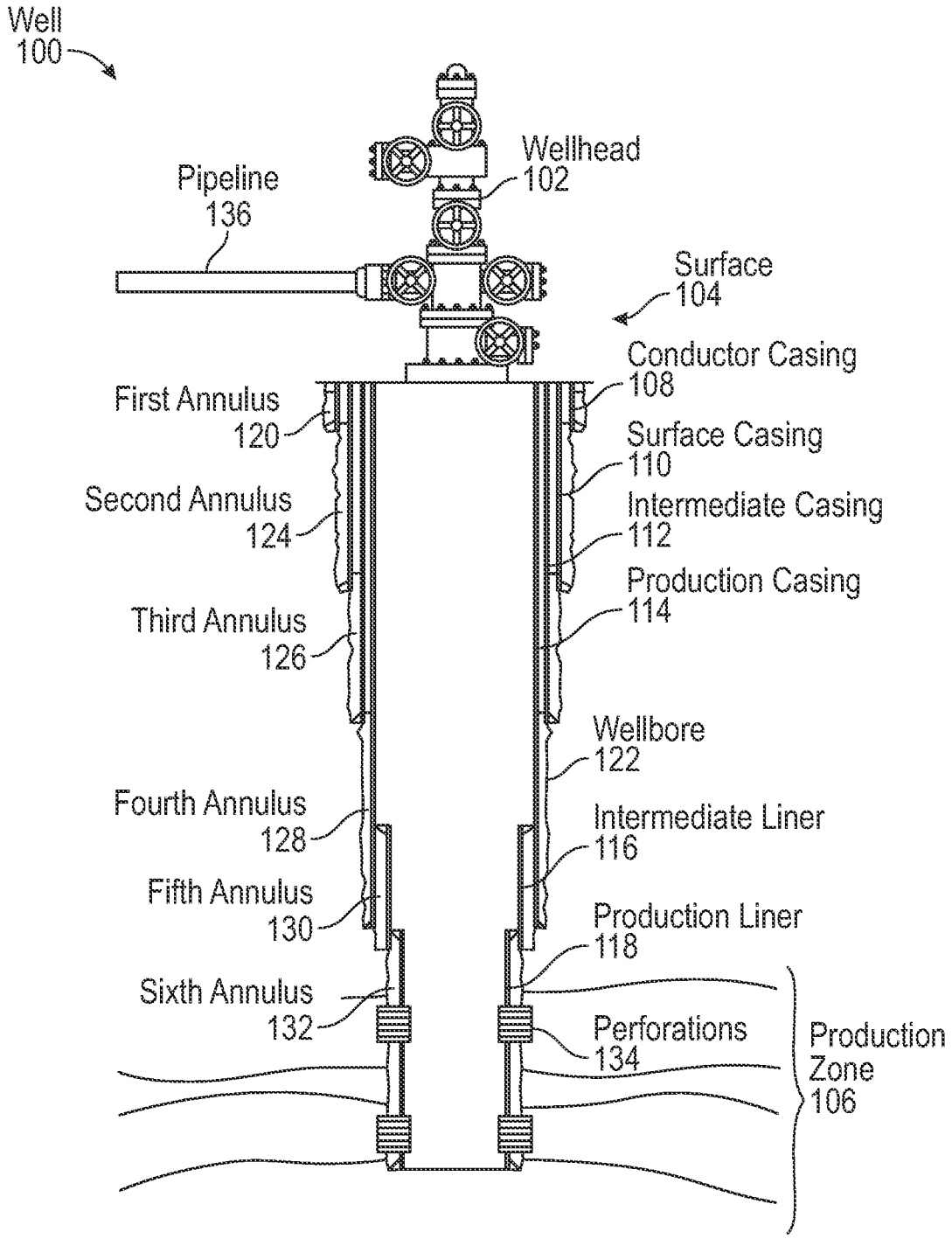
FIG. 1 shows an exemplary well in accordance with one or more embodiments.

FIG. 1 depicts an exemplary well (100) in accordance with one or more embodiments. The well (100) includes a wellhead (102) located on a surface (104) location that may be the Earth's surface. The wellhead (102) has a plurality of valves that control production of production fluids that come from a production zone (106) located beneath the surface (104). The valves also allow for access to the subsurface portion of the well (100) and the annuli located between various strings of casing. The wellhead (102) also provides a location for the surface (104)—reaching strings of casing to be hung off of.

The well (100) has six strings of casing: conductor casing (108), surface casing (110), intermediate casing (112), production casing (114), intermediate liner (116), and production liner (118). Each string of casing, starting with the conductor casing (108) and ending with the production liner (118), decreases in both outer diameter and inner diameter. Upon completion of the well (100), the inner surface of the production casing (114), intermediate liner (116), and production liner (118), and the space located within these strings of casing, make up the interior of the well (100). The interior of the well (100) may be accessed using various tools that may be run through the wellhead (102).

Each string of casing has an annulus that is located behind the casing string. The first annulus (120) is the space located between the outer diameter of the conductor casing (108) and the wellbore (122). The wellbore (122) is the exposed portion of the subsurface Earth. The first annulus (120) may be filled completely or partially with cement. The second annulus (124) includes both the space located between the outer diameter of the surface casing (110) and the inner diameter of the conductor casing (108) as well as the space between the outer diameter of the surface casing (110) and the wellbore (122). The second annulus (124) may be filled completely or partially with cement.

The third annulus (126) includes both the space located between the outer diameter of the intermediate casing (112) and the inner diameter of the surface casing (110) as well as the space between the outer diameter of the intermediate casing (112) and the wellbore (122). The third annulus (126) may be filled completely or partially with cement. The fourth annulus (128) includes both the space located between the outer diameter of the production casing (114) and the inner diameter of the intermediate casing (112) as well as the space between the outer diameter of the production casing (114) and the wellbore (122). The fourth annulus (128) may be filled completely or partially with cement.

The fifth annulus (130) includes both the space located between the outer diameter of the intermediate liner (116) and the inner diameter of the production casing (114) as well as the space between the outer diameter of the intermediate liner (116) and the wellbore (122). The fifth annulus (130) may be filled completely or partially with cement. The sixth annulus (132) includes both the space located between the outer diameter of the production liner (118) and the inner diameter of the intermediate liner (116) as well as the space between the outer diameter of the production liner (118) and the wellbore (122). The sixth annulus (132) may be filled completely or partially with cement.

The production liner (118) may be slotted liner or a screen such that fluid may flow into the production liner (118) from the formation. In this embodiment, there would be no cement in the sixth annulus (132). In other embodiments, the production liner (118) may be solid with cement in the sixth annulus (132) and perforations (134) may be made through the production liner (118), cement, and wellbore (122) in order to provide a pathway for production fluids to flow from the production zone (106) into the interior of the well (100). The formation fluids may travel from the interior of the well (100) to the surface (104) through production tubing (not pictured) and the wellhead (102). A pipeline (136) may be connected to the wellhead (102) to transport production fluids away from the well (100). The well (100) depicted in FIG. 1 is one example of a well (100) but is not meant to be limiting. The scope of this disclosure encompasses any well (100) design that has at least one string of casing in the well (100). Further, the well (100) may have any variation of surface equipment without departing from the scope of this disclosure.

Figure 2:
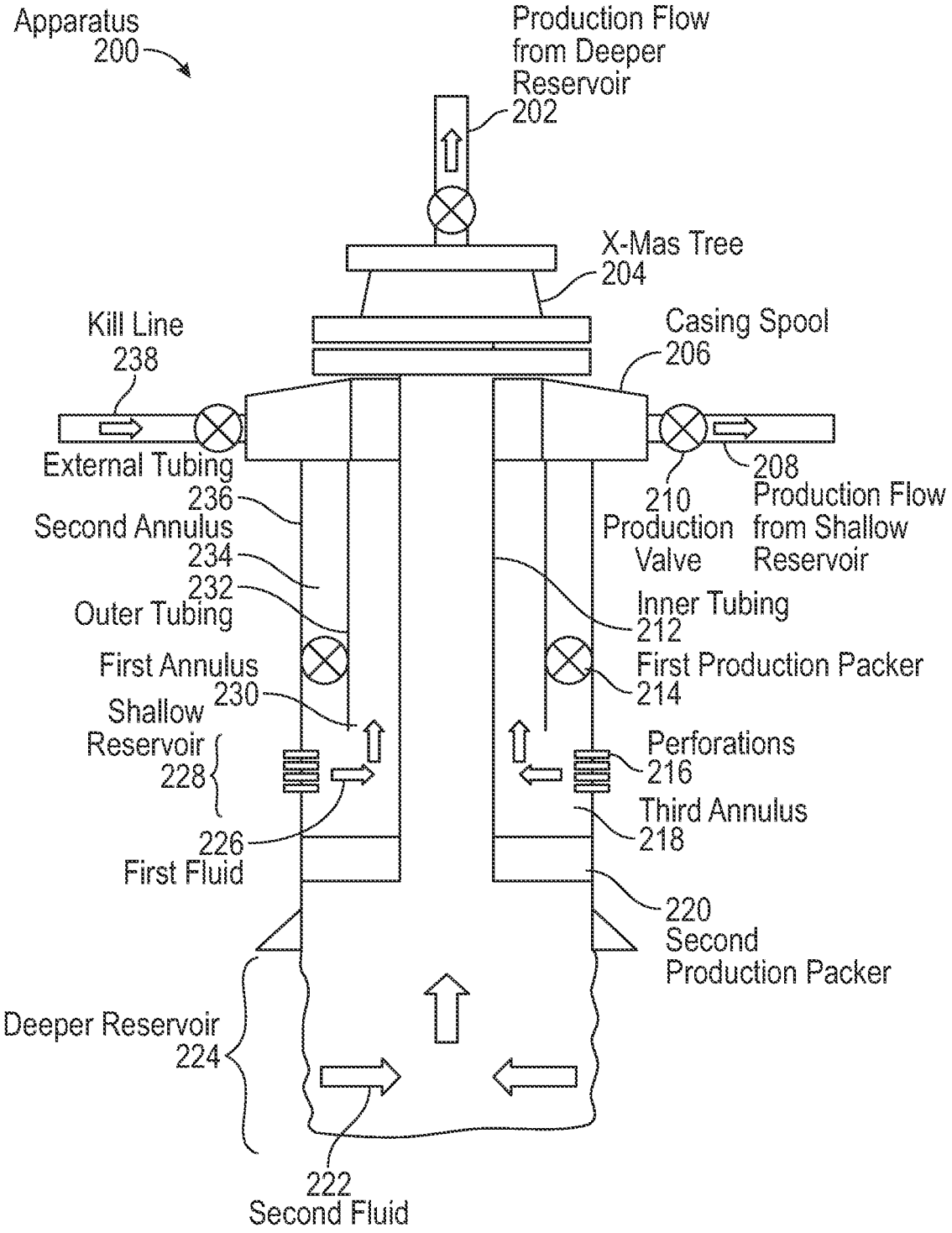
FIG. 2 shows an apparatus in accordance with one or more embodiments.

FIG. 2 depicts an apparatus (200) in accordance with one or more embodiments. In one or more embodiments, the apparatus is used to produce at least two different fluids from at least two distinct reservoirs, at different depths along the borehole. In one embodiment, the apparatus (200) is designed to produce from both a shallow reservoir (228) and a deeper reservoir (224), located at a depth below the shallow reservoir no less than 200 feet. More specifically, in one or more embodiments, the apparatus is configured to allow for production from both reservoirs (228, 224) simultaneously without commingling the fluids from each. The apparatus (200) includes an inner tubing (212) located concentrically within an outer tubing (232), which is located concentrically within an external tubing (236). For example, the external tubing may be a 9⅝ inch tubing set in a 12 inch hole, the outer tubing may be a 7 inch tubing set in a 8⅜ inch hole, and the inner tubing may be a 4½ inch tubing set in the 7 inch outer tubing. Between each set of concentric tubings, spaces known as annuli exist that allow drilling fluid to flow up to the surface. As shown in FIG. 2, a first annulus (230) includes the space between the outer diameter of the inner tubing (212) and the inner diameter of the outer tubing (232). A second annulus (234) includes the space between the outer diameter of the outer tubing (232) and the inner diameter of the external tubing (236). A third annulus (218) includes the space between the outer diameter of the inner tubing (212) and the inner diameter of the external tubing (236). In one or more embodiments, a first production packer (214) may be installed in the second annulus (234), above the shallow reservoir (228). A second production packer (220) may be installed in the third annulus (218), between the shallow reservoir (228) and the deeper reservoir (224). For example, the first packer may be a 7 inch by 9⅝ inch packer and the second packer may be a 4½ inch by 9⅝ inch packer. The packers are configured to expand once disposed into the borehole in order to isolate/block certain portions of the apparatus as explained below.

A first fluid (226) produced from the shallow reservoir (228) may be transported to the surface via the first annulus. In one embodiment, the first fluid (226) may be gas. However, it will be apparent to one of ordinary skill in the art that there are alternate embodiments wherein the first fluid is not gas. For example, the first fluid may be oil, gas, water or any combination thereof. Perforations (216) may be made through the external tubing (236) to provide a pathway for the production fluids to flow from the shallow reservoir (228) into the interior of the apparatus (200), as indicated by the arrows labelled first fluid in FIG. 2. The first production packer (214) may prevent exposure of the second annulus (234) to production fluids, limiting the possibility of sweet or sour corrosion in the second annulus (234). A second fluid (222) produced from the deeper reservoir (224) may be transported to the surface via the inner tubing (212). In one embodiment, the second fluid (222) may be oil. However, it will be apparent to one of ordinary skill in the art that there are alternate embodiments wherein the second fluid is not oil. For example, the second fluid may be oil, gas, water, or any combination thereof. The positioning of the second production packer (220) between the shallow reservoir (228) and the deeper reservoir (224) prevents comingling of the first and second fluids, (226) and (222), respectively.

The inner tubing (212) is completed with a conventional Christmas tree assembly (204), from which the second fluid (222) is carried via the first production line (202). The outer tubing (232) is completed by the casing spool (206), from which the first fluid (226) is carried via the second production line (208). One or more production valves (210) are installed after the casing spool and act as wellhead barriers. A kill line (238) is connected to the casing spool (206).

Figure 3:
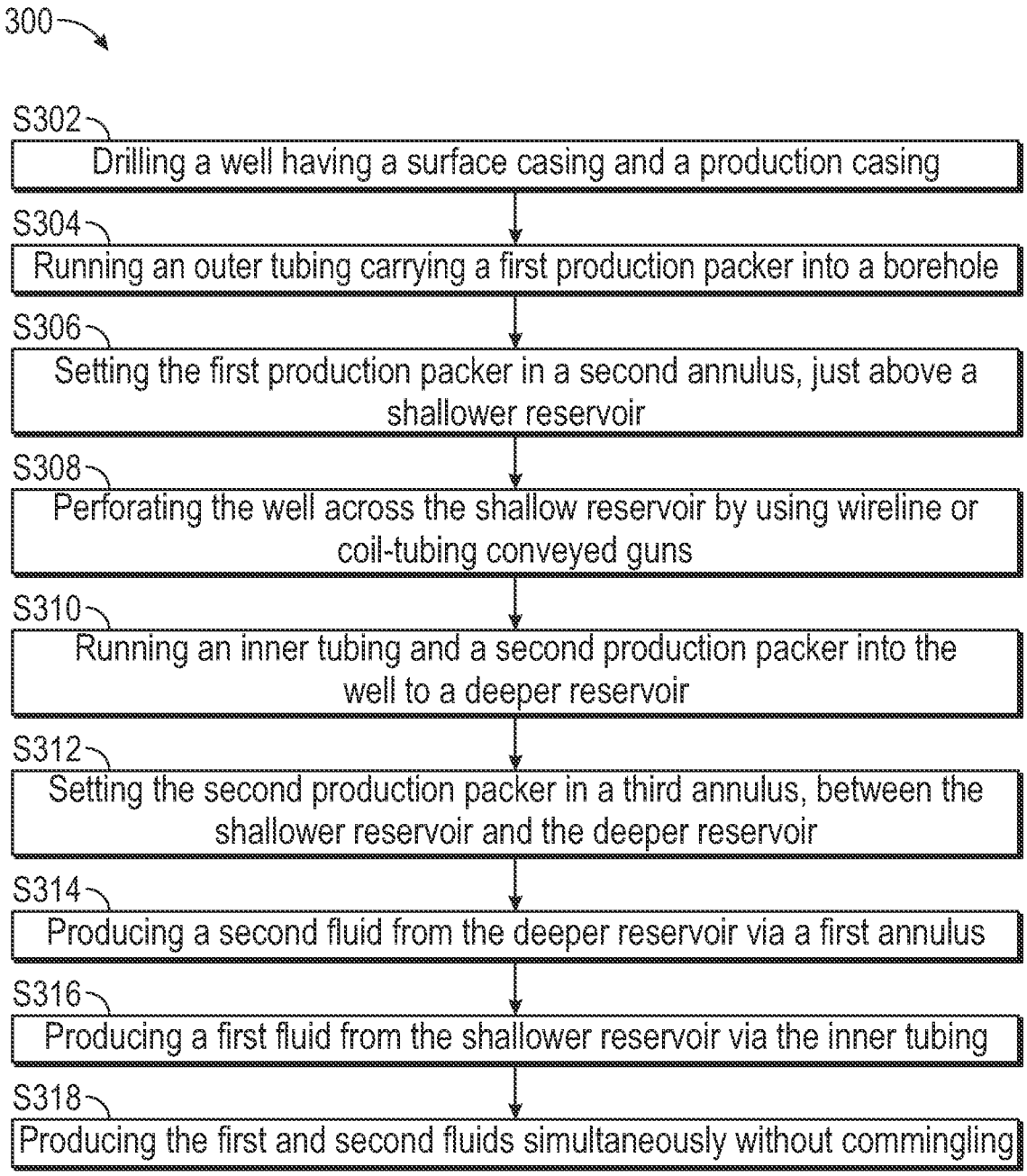
FIG. 3 shows a flowchart in accordance with one or more embodiments.

FIG. 3 depicts a flowchart in accordance with one or more embodiments. More specifically, FIG. 3 depicts a method (300) for producing two or more different fluids from two or more reservoirs using a single well without commingling fluids. Further, one or more blocks in FIG. 3 may be performed by one or more components as described in FIGS. 1 and 2. Furthermore, the blocks may be performed actively or passively.

Initially a well (100) is drilled to a depth between a shallow reservoir (228) and a deeper reservoir (224) (S302). The well (100) is covered with production casing by running a string of pipe to the bottom of the well (100) and pumping cement behind the pipe. In one or more embodiments, the string of pipe may be an external tubing (236). A narrower, deeper hole is then drilled to a depth below the deeper reservoir (224) and open hole logging is performed as required (S302). Once logging operations have been completed, an outer tubing (232), carrying a first production packer (214), is run into the hole until the first production packer (214) is disposed at least 70 feet above the shallow reservoir (228) (S304). The first production packer is set above the shallow reservoir (228) by rotating the outer tubing (232) and applying compression (S306). Over-pull is then applied to fully set the first production packer (214), preventing any upward movement. A tubing hanger is set, and the outer tubing (232) is landed in a casing spool (206). A tubing head spool is installed.

Perforations (216) are made across the well (100) at the level of the shallow reservoir (228) to allow the flow of fluid from the reservoir into the first annulus (230) (S308). For example, perforations may be made using wireline or coil-tubing conveyed guns. At this stage, it is essential that fluid in the first annulus (230) overbalances the pressure in the shallow reservoir (228) to prevent a well control incident. An inner tubing (212) and second production packer (220) are then run into the well (100) to a setting depth (S310). In one or more embodiments, the setting depth may be located just above the bottom of the inner tubing (212). The second production packer is set in the third annulus (218), between the shallow reservoir (228) and the deeper reservoir (224), in the same manner as the first production packer (214) (S312). A second tubing hanger is set in the tubing head spool. A Blowout Preventer (BOP), installed during S302, is uninstalled and the conventional Christmas tree assembly (204), which completes the inner tubing (212), and a coil tubing (CT) unit are nippled up. The second fluid (222) is lifted from the deeper reservoir (224) when the CT unit is run into the inner tubing (212) and nitrogen is pumped. As the deeper reservoir (224) begins to flow, the second fluid (222) is lifted up the inner tubing (212), through the conventional Christmas tree assembly (204) and into the first production line (202) (S314). The first annulus (230) is opened, allowed the first fluid (226) to flow from the shallow reservoir (228) through the casing spool (206) to the second production line (208) (S316). The first and second fluids, (226) and (222), respectively, are produced simultaneously from both the shallow and deeper reservoirs, (228) and (224), respectively, without any commingling of fluids (S318).

Embodiments of the present disclosure may provide at least one of the following advantages. The process of drilling wells is known to be expensive and time-consuming. An apparatus or method as described herein that allows for production from two separate reservoirs within a single well eliminates the need and cost associated with drilling an additional well to access a reservoir that may be incompatible. Additionally, contact of the external tubing with production fluids is known to be undesirable due to the possibility of sweet or sour corrosion. The placement of production packers in the present disclosure effectively seals the respective annuli, ensuring production fluids do not come into contact with the external tubing, therefore limiting the risk of sweet or sour corrosion. Production from multiple layers/reservoirs without commingling at well level avoids issues arising from commingled production in oil/water and/or gas wells. In order to achieve this, the setup includes an inner tubing string that produces from the deeper formation, isolated from the shallow layer through a downhole packer. The outer tubing string produces from the shallow interval. The inner tubing string does not have a tubing-casing annulus (TCA), while the outer tubing has a conventional TCA.

Those skilled in the art will appreciate that because the outer tubing is completed with the two horizontal valves as wellhead barriers, intervention in the outer tubing interval may only be performed during workover operations. A surface multiphase flow meter system can also be installed with bypasses to enable wellsite testing of both reservoirs.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. An apparatus for obtaining fluids via a well, comprising:

an outer tubing disposed in the well and set at a shallow reservoir comprising a first fluid;

an inner tubing disposed concentrically within the outer tubing and set at a deeper reservoir further downhole than the shallow reservoir, the deeper reservoir comprising a second fluid;

a first packer disposed between the outer tubing and an external tubing and disposed above the shallow reservoir; and a second packer disposed between the external tubing and the inner tubing and disposed above the deeper reservoir, wherein the second packer blocks an annulus through which the first fluid is extracted, wherein the first fluid is produced from the shallow reservoir and the second fluid is produced from the deeper reservoir simultaneously by drilling via the well, and wherein the first fluid is gas and the second fluid is oil.

2. The apparatus of claim 1, further comprising: a plurality of perforations in the external tubing of the well at the shallow reservoir, wherein the first fluid flows through the plurality of perforations in the external tubing and up the annulus.

3. The apparatus of claim 1, wherein the outer tubing is completed with a casing spool via which the first fluid flows to a production line.

4. The apparatus of claim 1, wherein the inner tubing is completed with a Christmas tree apparatus at a wellhead of the well via which the second fluid flows to a production line.

5. The apparatus of claim 4, wherein the outer tubing comprises two production valves that act as a barrier to the wellhead.

6. The apparatus of claim 1, wherein the first fluid and the second fluid are extracted using the well without commingling the first fluid and the second fluid.

7. A method for obtaining fluids via a well, comprising:

running a drill string down a wellbore to set an outer tubing in the well, wherein the well comprises an external tubing and wherein the outer tubing is set at a shallow reservoir comprising a first fluid;

disposing a first packer into the well between the outer tubing and the external tubing and above the shallow reservoir;

running the drill string down the wellbore to set an inner tubing and a second packer within the external tubing in the well, wherein the inner tubing is set at a deeper reservoir further downhole than the shallow reservoir, the deeper reservoir comprising a second fluid, wherein the second packer is disposed between the external tubing and the inner tubing and above the deeper reservoir, producing the first fluid from the shallow reservoir, wherein the first fluid is produced via an annulus between the outer tubing and the inner tubing; and producing the second fluid from the deeper reservoir simultaneously with production of the first fluid, wherein the second fluid is produced straight through the inner tubing, wherein the second packer blocks the annulus through which the first fluid is extracted via the outer tubing, and wherein the first fluid is gas and the second fluid is oil.

8. The method of claim 7, further comprising: perforating the external tubing of the well at the shallow reservoir, wherein the first fluid flows through the perforations in the external tubing and up the annulus.

9. The method of claim 8, wherein the external tubing is perforated using wireline or coil-tubing conveyed guns.

10. The method of claim 7, wherein the first fluid and the second fluid are produced using the well without commingling the first fluid and the second fluid.

11. The method of claim 7, wherein the outer tubing is completed with a casing spool via which the first fluid flows to a production line.

12. The method of claim 7, wherein the inner tubing is completed with a Christmas tree apparatus at a wellhead of the well via which the second fluid flows to a production line.

13. The method of claim 7, further comprising: lifting the well by running the inner tubing in a narrower hole and pumping nitrogen to allow flow from the deeper reservoir via an inner completion string.

14. The method of claim 7, wherein the inner tubing is concentric with the outer tubing and is within the outer tubing.

* * * * *